US007336241B2

(12) United States Patent
Bailey et al.

(10) Patent No.: US 7,336,241 B2
(45) Date of Patent: Feb. 26, 2008

(54) GPS RADOME-MOUNTED ANTENNA ASSEMBLY

(75) Inventors: Nancy N. Bailey, La Mesa, CA (US); Daniel H. Weber, Escondido, CA (US)

(73) Assignee: Qualcomm Incorporated, San Diego, CA (US)

( * ) Notice: Subject to any disclaimer, the term of this patent is extended or adjusted under 35 U.S.C. 154(b) by 184 days.

(21) Appl. No.: 11/228,133

(22) Filed: Sep. 15, 2005

(65) Prior Publication Data

US 2007/0057862 A1 Mar. 15, 2007

(51) Int. Cl.
*H01Q 1/42* (2006.01)

(52) U.S. Cl. ..... 343/872; 343/700 MS

(58) Field of Classification Search ..... 343/700 MS, 343/872, 876, 757, 873
See application file for complete search history.

(56) References Cited

U.S. PATENT DOCUMENTS 3,794,997 A 2/1974 Iwatsuki et al.
5,742,255 A * 4/1998 Afendras ..... 343/713
5,818,393 A * 10/1998 Fowler et al. ..... 343/705
5,977,710 A * 11/1999 Kuramoto et al. ... 343/700 MS
6,339,397 B1 1/2002 Baker
7,027,004 B2 * 4/2006 Haunberger et al. ..... 343/790
2004/0257298 A1 * 12/2004 Larouche et al. ..... 343/895
2005/0035923 A1 * 2/2005 Syed et al. ..... 343/872

FOREIGN PATENT DOCUMENTS

DE 19841187 C1 2/2000
EP 0795925 A2 9/1997
JP 02141007 A 5/1990
JP 07176925 A 7/1995
WO 9963617 A 12/1999

* cited by examiner

*Primary Examiner*—Hoanganh Le
(74) *Attorney, Agent, or Firm*—Richard A. Bachand

(57) ABSTRACT

In an antenna communications unit which, when installed on trucks, allows two-way communications between a driver and fleet logistic centers, historically, a global positioning system (GPS) antenna within a radome has been housed in a cavity beneath a transceiver's messaging antenna. A method and device is provided which moves the GPS antenna from beneath the messaging antenna and places it in an enclosure mounted to the radome.

15 Claims, 2 Drawing Sheets

GPS RADOME-MOUNTED ANTENNA ASSEMBLY

BACKGROUND

Typically, mobile tracking and messaging antennas for mobile tracking and messaging systems, such as that used with Qualcomm Incorporated's OmniTRACS® system, are housed within a radome. A radome is an enclosed housing, usually made of a low-loss dielectric material that serves to protect antennas mounted on ground-based vehicles, ships, airplanes and the like without significantly altering the electrical performance of the enclosed antennas.

Transit buses and heavy industrial equipment having tracking and messaging systems are well suited for use with radomes. The dielectric material of the radome is usually made of a plastic material having a thickness on the order of the wavelength associated with an antenna used therewith.

Mobile tracking of equipment, such as industrial vehicles, can involve the Global Positioning System (GPS) which can be used to track vehicles using a number of low earth orbiting satellites.

FIG. 1 illustrates a three-dimensional perspective view of a prior art messaging and tracking antenna setup, including an antenna assembly, referenced herein as antenna communications unit (ACU) 2. ACU 2 in conjunction with circuitry, not shown, is a mobile transceiver. The ACU, when in installed in vehicles, such as trucks, allows two-way communication between drivers and logistic centers. GPS patch antenna 4, mounted to ground plane 5, provides reception of GPS signals which, for instance, allow truck systems controllers to know the location of a truck and its cargo. Patch antenna 4 and ground plane 5 are disposed on cast aluminum base 6 covered by radome 8. Base 6 of ACU 2 can be mounted to a vehicle (e.g., tractor cab). Radome 8 can be attached to base 6 preferably a using v-clamp. Rotating messaging antenna 10 which is well-suited for digital communications involving geostationary satellites, particularly involving code division multiple access (CDMA), is rotatable on pedestal 11 about axis 12 through radome 8 in a plane between peak 14 of radome 8 and base 6. Antenna 10 of FIG. 2 is illustrated as a horn antenna. A system of this type can, for example, use an uplink (transmit) frequency band of 14.0-14.5 GHz while the downlink (receive) frequencies range from 11.7-12.2 GHz. In an effort to improve satellite communications, antenna 10 rotates toward a satellite in connection with communication therewith.

While the messaging antenna is capable of movement to increase transmission and reception signal strength, the GPS antenna is stationary. In order to optimize GPS performance, it is desirable to locate the GPS antenna in clear line of sight to the GPS satellite constellation.

A method and apparatus for improving the GPS satellite reception is needed.

Figure 1:
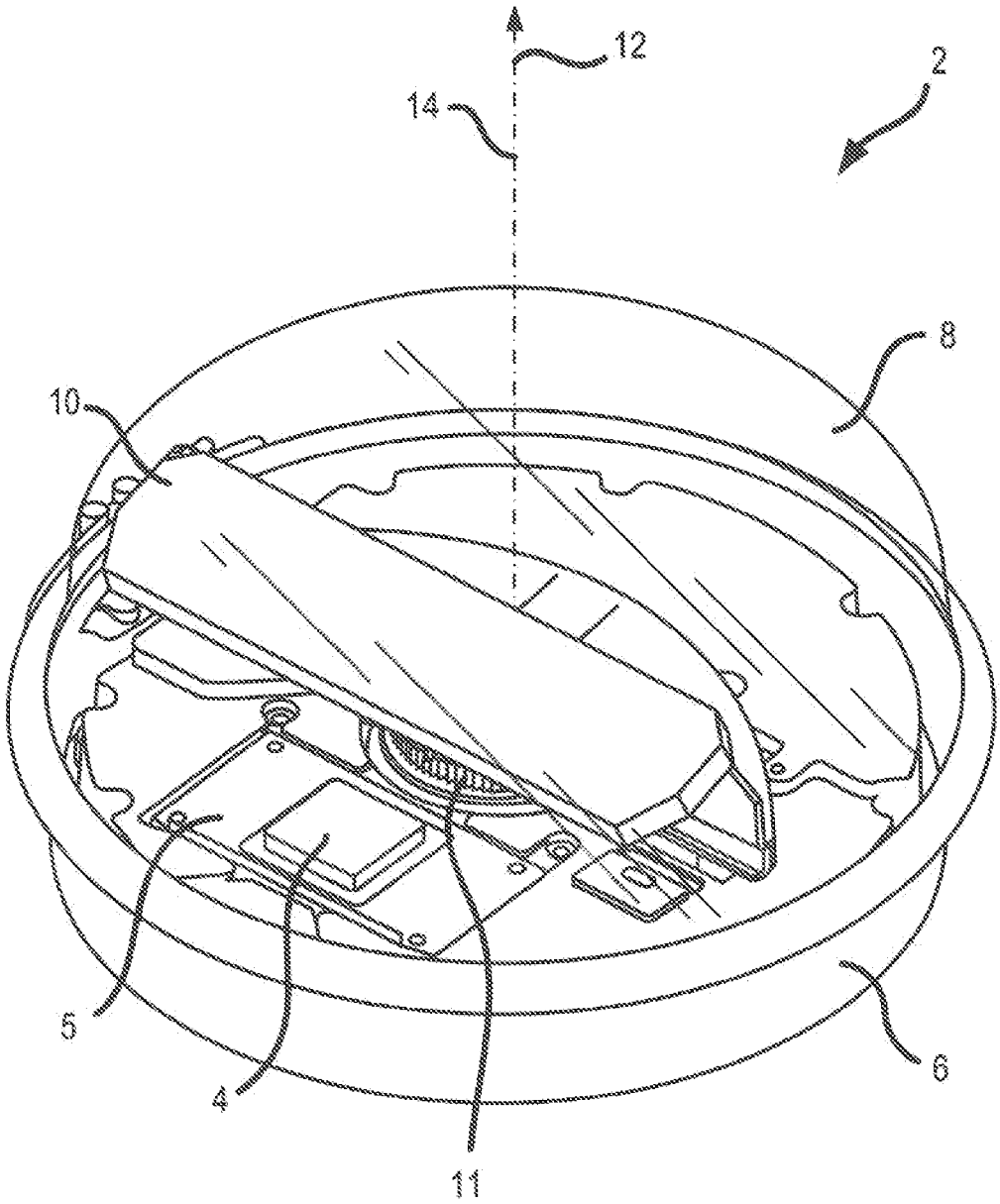
FIG.1 (PRIOR ART)
FIG. 1 illustrates a three-dimensional perspective view of a prior art messaging and tracking antenna setup, which forms antenna communications unit (ACU).

Applicable reference numerals have been carried forward.

DETAILED DESCRIPTION

Figure 2:
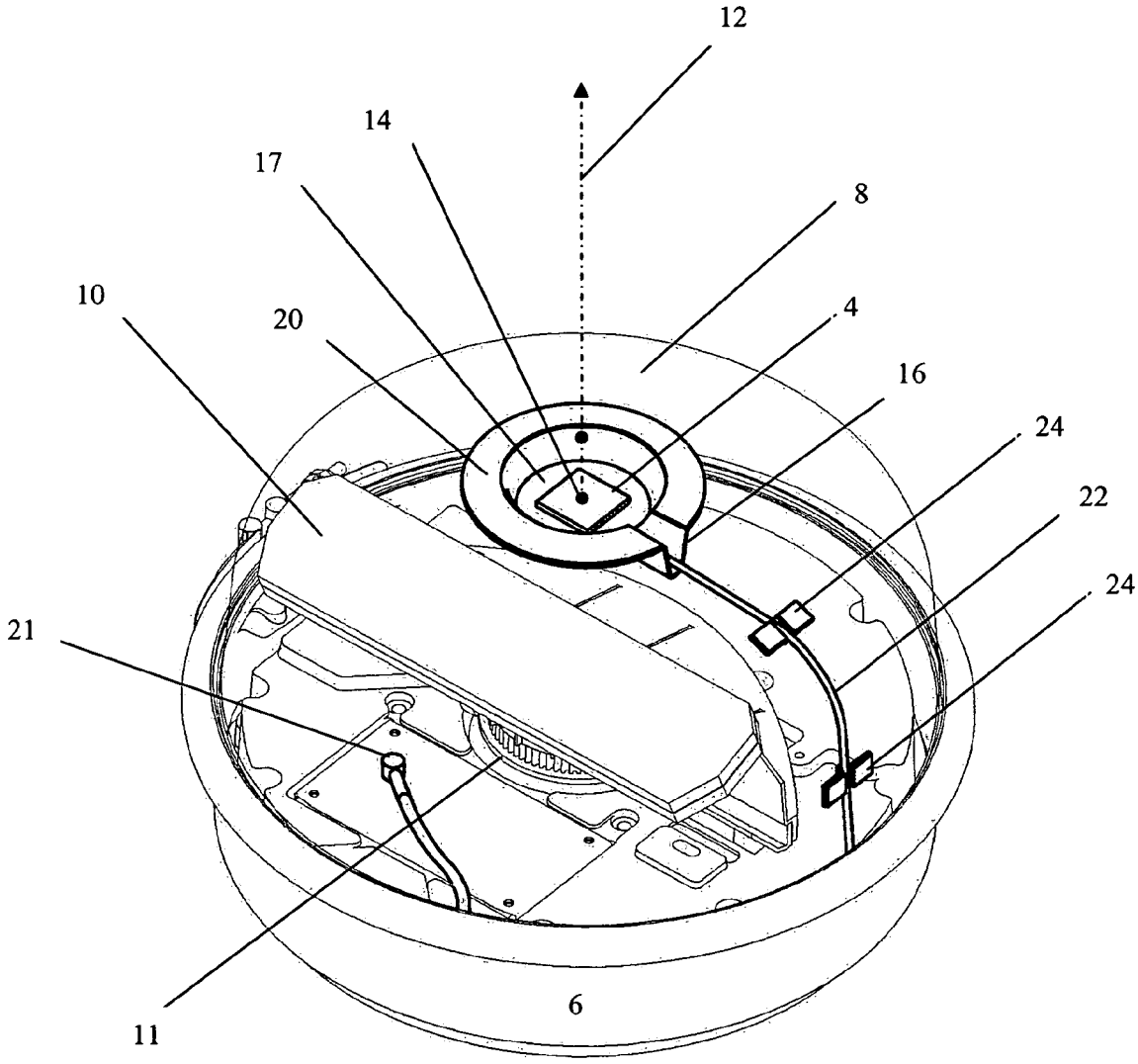
FIG. 2 presents a three-dimensional perspective view of a patch antenna connected to a radome.

In order to improve GPS satellite reception, in one embodiment, the GPS antenna is moved from the base of the ACU as shown in FIG. 1 to being attached to the radome itself as shown in FIG. 2. FIG. 2 presents a three-dimensional perspective view of patch antenna 4 connected to radome 8. The radome is preferably fabricated using a method of thermoforming. Thermoforming is a manufacturing process which transforms a thin thermoplastic sheet or film into a formed component. In one method of thermoforming, a sheet or film is heated between infrared heaters to its forming temperature and then is stretched over a temperature-controlled, single-surface metal mold. The sheet or film is held against the mold until it cools.

With reference still to FIG. 2, GPS patch antenna 4 lies within thermoformed antenna cup 16 which is adhered to radome 8 by adhesive ring 20. Circular shaped ground plane 17 is adhered to cup 16 by a second adhesive ring (not shown). A soldered connection 14 of predetermined length joins ground plane 17 to patch antenna 4. The length of connection 14 has bearing on the gain associated with antenna 4. GPS coaxial antenna cable 22 is connected to ground plane 17 and is adhered to and along a wall of radome 8 enclosing, among other things, patch antenna 4 and rotating messaging antenna 10. Cable 22 is connected at another end to circuitry 21 within the transceiver formed by ACU 2. In one aspect, radome 8 is preferably constructed from a thin polycarbonate. However, the thin-walled thermoformed radome is not conducive toward allowing radome attachment of cup 16 and cable 22 by way of rivet, other conventional threaded fasteners (e.g., screws) or other commonly available measures since the thermoplastic can easily crack in connection with such measures, thus creating a moisture ingress path from the region of penetration. This is particularly deleterious to ACU 2 since base 6 and radome 8, in one aspect, are sealed to help isolate ACU 2 from the surrounding environment. In experimental tests, ultrasonic weld and solvent bond methods of adhesion of cup 16 to radome 8 proved unacceptable, causing radome 8 to become embrittled. Adhesion of cup 16 and cable 22 using 3M™ VHB™ 5952 pressure sensitive adhesive tape obviated any need for screws, rivets, and silicones.

One challenge in implementing the attachment of cable 22 and cup 16, containing patch antenna 4, to radome 8 lie in identifying a robust mount that would be able to withstand years of fatigue in an outdoor mobile application while potentially being exposed to the Earth's most extreme climates. ACU 2 is frequently deployed in harsh, inhospitable regions of the world and as such, it must operate reliably when exposed to diverse climatic conditions offered by high humidity scenarios encountered in the Amazon River basin, extreme heat typical of desserts in the American southwest and rugged terrain and winter temperatures reaching −40° C. in northern Alaska. The method of attachment would be subjected to rapid excursions in temperature, extended exposure to hot and cold extremes, and high impact stress at severe cold temperatures. Preferably, the bonding agent used for adherence would have low water absorption properties and demonstrate a high degree of radio frequency (RF) transparency over a range of frequencies.

After much experimental testing, adhesion to radome 8 was obtained using a double-sided adhesive tape. It was determined that commercially available 3M™ VHB™ 5952 tape was best suited to adhere cup 16, containing patch antenna 4, and GPS antenna cable 22 to radome 8. 3M™ VHB™ 5952 is a very high bond, double-sided acrylic foam tape. As illustrated in FIG. 2, two strips of tape 24 are applied to adhere cable 22 to the enclosing wall of radome 8. As shown, cable 22 is captured under a strap fastened to radome 8 with two ends of tape 24. Tape 24 is deformable so as to securely affix cable 22 to the surface of radome 8 through the foam surface. Adhesive ring 20 is a double-sided adhesive used to secure cup 16 on one side and radome 8 on the other, made from 3M™ VHB™ 5952 tape in a preferred embodiment. A smaller adhesive ring (not shown) is likewise a double-sided adhesive ring made from 3M™ VHB™ 5952 tape which secures ground plane 17 to cup 16.

EXAMPLES

The high performance tape holding the GPS antenna cup to the radome was required to demonstrate durability under a number of stringent tests. A primary goal of this testing was to observe the stress responses of the tape in order to maintain its suitability and long-term reliability in the radome mounted GPS application.

Thermal shock tests were performed to determine the ability of the high performance tape to withstand sudden changes in temperature. Specifically, vibration tests were conducted to demonstrate the capacity of the tape to withstand the dynamic stress typically encountered in a usage environment. Vibration tests over hot and cold temperatures were also performed to demonstrate the ability of the tape to survive under conditions most likely to cause tensile or shear failures.

Heavy impact tests were done to meet limited market requirements contemplated for customers concerned with vandalism. Further, aggressive side impact tests were performed to assure that a low-hanging tree branch striking the side of the radome would not result in adhesion failure.

The present embodiments are further illustrated by the following examples demonstrating the testing undergone by the foregoing described adhesive tape in which the tape held its bond during such testing. It was determined that an improved bond could be obtained using an adhesion promoter during adhesion of cup 16 and cable 22 to radome 8. Further, thermal shock testing demonstrated improved results by increasing the surface area of the affixed tape.

Accumulated Stress Test

Fifteen thermal shock cycles in an air-to-air thermal shock chamber (−50° C. to +85° C.) followed by 9 hr 5.2 (root mean squared) RMS random vibe (10-1000 Hz) and a quantity of 54, 20 G amplitude bump shocks (half sine, 11 ms).

Simultaneous Temperature and Vibration

Cold random vibration (1 hr. 5.2 gRMS, 10-1000 Hz) performed in the vertical axis while ACUs were held at 50° C. (worst case condition due to reduced tensile strength of the tape at cold temperature). Hot vibration (1 hr, 5.2 gRMS, 10-1000 Hz) performed in the horizontal axis while ACUs were held at +85° C. (worst case condition due to reduced tape shear strength at high temperature).

Temperature-Humidity Cycling

−40° C. to +70° C. and 90% relative humidity (RH), 8 hr cycle, 17 day duration.

Storage Temperature Cycling

−50° C. to +85° C., 8 hr cycle, 17 day duration.

Ambient Top-Down Impact

Three strikes from a 20 oz mass hitting the radome at an impact speed of 28 mph.

Cold Top-Down Impact

Three radome strikes from a 20 oz mass dropped 12 in. (free-fall) while ACU is cold (−50°).

Ambient Side Impact

One strike from a spring-loaded bar hitting the radome at an impact speed of 25 mph.

Cold Side Impact

One strike from a spring-loaded bar hitting the radome at an impact speed of 25 mp while the ACU is cold (50° C.).

Although the invention herein has been described with reference to particular embodiments, it is to be understood that these embodiments are merely illustrative of the principles and applications of the present invention. For example, messaging antenna 10 of FIG. 2 can represent a phased array antenna. Further, although, described herein with reference to a transceiver, the foregoing embodiments can be modified to operate with solely a receiver or solely a transmitter. It is therefore to be understood that numerous modifications may be made to the illustrative embodiments and that other arrangements may be devised without departing from the spirit and scope of the present invention as defined by the appended claims.

We claim:

1. A transceiver including a radome, comprising:

a base adapted to secure the radome,
wherein the radome is thermoformed;

a first antenna connected to said base;

a cup mounted on the inner surface of the radome adapted to house a second antenna and at least one ground plane;

an adhesive ring having a first side and second side,
wherein the second side is disposable on the radome adapted to connect the cup containing the second antenna to the radome, and the first side is adapted to connect the cup to the adhesive ring; and an antenna cable connected by adhesion to the first antenna and radome.

2. A transceiver as recited in claim 1 wherein said first antenna represents a messaging antenna and wherein said second antenna is a GPS antenna.

3. A transceiver as recited in claim 2 wherein said messaging antenna includes a base upon which said antenna is capable of rotation.

4. A transceiver as recited in claim 2 wherein said first antenna is a horn antenna.

5. A transceiver as recited in claim 1 wherein said first antenna is interposed between said base and said second antenna.

6. A transceiver as recited in claim 1 wherein said radome is in substantially the shape of a sphere.

7. A transceiver as recited in claim 1 wherein said second antenna is a patch antenna.

8. A transceiver as recited in claim 1 wherein said adhesive ring is double-side adhesive tape is an acrylic foam tape.

9. A transceiver as recited in claim 1, wherein said antenna cable is secured to said radome at selected regions of said radome using adhesive tape.

10. A transceiver as recited in claim 9 wherein said adhesive tape is acrylic foam tape.

11. A transceiver as recited in claim 1 wherein said radome is thermoformed from a polycarbonate material.

12. A method of securing an element of an antenna assembly to a cup comprising the steps of:

selecting an adhesive ring having a first side and a second side;

thermoforming a radome for housing the antenna assembly; disposing the second side of the adhesive ring on the inner surface of the radome; and disposing the first side of the adhesive ring on the cup for adhering said element to said cup.

13. A method of securing an element of an antenna assembly as recited in claim 12 wherein said adhesive tape comprises an acrylic foam tape.

14. A method of securing an element of an antenna assembly as recited in claim 12 further including using an adhesion promoter between said element and said radome.

15. A method of securing an element as recited in claim 12 wherein said element comprises an antenna ground plane.

* * * * *